US012553171B2

(12) United States Patent
Patil et al.

(10) Patent No.: US 12,553,171 B2
(45) Date of Patent: Feb. 17, 2026

(54) RECIRCULATION HOSE ROUTING FOR A LAUNDRY APPLIANCE

(71) Applicant: Whirlpool Corporation, Benton Harbor, MI (US)

(72) Inventors: Ajiket Patil, Maharashtra (IN); Ryan James Van Zoest, Benton Harbor, MI (US); Chris Borlin, St. Joseph, MI (US); Mohsin M. Attar, Maharashtra (IN); John Meisner, Tiffin, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 587 days.

(21) Appl. No.: 17/950,559

(22) Filed: Sep. 22, 2022

(65) Prior Publication Data

US 2024/0102228 A1 Mar. 28, 2024

(51) Int. Cl.
*D06F 39/08* (2006.01)
*D06F 39/14* (2006.01)

(52) U.S. Cl.
CPC ..... *D06F 39/085* (2013.01); *D06F 39/14* (2013.01); *D06F 39/083* (2013.01)

(58) Field of Classification Search
CPC ..... D06F 39/14; D06F 39/083; D06F 39/085
See application file for complete search history.

(56) References Cited

U.S. PATENT DOCUMENTS

| | | | | |
|---|---|---|---|---|
| 2,836,047 | A * | 5/1958 | Condit | D06F 39/083 138/44 |
| 4,168,615 | A * | 9/1979 | Condit | D06F 39/083 137/403 |
| 8,490,439 | B2 | 7/2013 | Hill et al. | |
| 9,702,079 | B2 | 7/2017 | Bondi et al. | |
| 9,957,660 | B2 | 5/2018 | Kim et al. | |
| 10,077,523 | B2 | 9/2018 | Im et al. | |
| 10,145,052 | B2 | 12/2018 | Kim et al. | |
| 2013/0081431 | A1* | 4/2013 | Hill | D06F 39/083 68/12.12 |
| 2013/0192084 | A1* | 8/2013 | Hill | D06F 35/008 68/12.02 |
| 2014/0208810 | A1 | 7/2014 | Zattin et al. | |

(Continued)

FOREIGN PATENT DOCUMENTS

| | | | | |
|---|---|---|---|---|
| DE | 19810221 | A1 * | 9/1999 | D06F 39/086 |
| DE | 112016000314 | T5 * | 10/2017 | D06F 39/083 |

(Continued)

*Primary Examiner* — Benjamin L Osterhout
(74) *Attorney, Agent, or Firm* — Brooks Kushman, P.C.

(57) ABSTRACT

A laundry appliance including a cabinet, a wash unit tub inside the cabinet, and a drum rotatably supported within the wash unit tub. The wash unit tub includes a front tub wall having a front tub opening. The drum defines a laundry compartment therein and includes a front drum opening that provides access to the laundry compartment. A front facia is mounted to the front tub wall of the wash unit tub. A recirculation hose extends between a pump that is positioned inside the cabinet at a location below the wash unit tub and a recirculation nozzle that is mounted to the wash unit tub at a position near the top of the front tub opening. The recirculation hose passes through a window in the front facia and is routed through a gap that is disposed between the front tub wall and the front facia to the recirculation nozzle.

20 Claims, 9 Drawing Sheets

(56) References Cited

U.S. PATENT DOCUMENTS

| | | | | |
|---|---|---|---|---|
| 2015/0191861 | A1 | 7/2015 | Alessandrini et al. | |
| 2017/0096770 | A1* | 4/2017 | Kim | D06F 39/085 |
| 2019/0203405 | A1 | 7/2019 | Lee et al. | |
| 2019/0323162 | A1 | 10/2019 | Jung et al. | |
| 2023/0018094 | A1* | 1/2023 | Pessot | B01D 39/16 |

FOREIGN PATENT DOCUMENTS

| | | | | |
|---|---|---|---|---|
| EP | 2267211 | A1 | 12/2010 | |
| EP | 2392720 | A1 | 12/2011 | |
| EP | 2137347 | B1 | 2/2013 | |
| EP | 2746448 | A1 | 6/2014 | |
| EP | 3546635 | A1 * | 10/2019 | D06F 39/085 |
| EP | 4001495 | A1 * | 5/2022 | D06F 39/083 |
| KR | 100393994 | B1 | 8/2003 | |

* cited by examiner

RECIRCULATION HOSE ROUTING FOR A LAUNDRY APPLIANCE

FIELD

The present disclosure relates to the routing of a recirculation hose in a laundry appliance, such as a combination washer/dryer, and related hardware.

BACKGROUND

This section provides background information related to the present disclosure which is not necessarily prior art.

Laundry appliances (i.e., laundry machines, washing machines, and dryers) are prolific in both residential and commercial settings. Traditionally, separate washer and dryer machines have been used in tandem to clean and dry laundry. However, there is a growing market for washer and dryer combination appliances where a single machine performs both the washing and drying functions, thereby eliminating the need for two separate machines. There are a number of different names used to describe washer and dryer combination appliances, including without limitation, "washer/dryer combos" and "all-in-one washer dryers."

Many washer and dryer combination appliances have a front-load appliance configuration, where the washer and dryer combination appliance includes a cabinet (i.e., an appliance housing) with a front opening that is accessed by a front-mounted appliance door. A tub is positioned inside the cabinet. A drum is positioned inside the tub and is rotatable with respect to the tub. The drum typically has a front end with a drum opening that provides access to a laundry compartment inside the drum.

While washer and dryer combination appliances save space compared to separate washer and dryer machines, combining the washing and drying functions into a single appliance presents a number of engineering challenges. For example, traditional washer and dryer combination appliances have limited packaging space available. Furthermore, decisions to include systems that improve the performance and efficiency of the wash cycle, such as water recirculation systems, are often made based on packaging constraints and other limitations. Thus, better packaging solutions are needed.

SUMMARY

This section provides a general summary of the disclosure and is not a comprehensive disclosure of its full scope or all of its features.

In accordance with one aspect of the present disclosure, a laundry appliance is provided that comprises a cabinet, a wash unit tub, and a drum. The wash unit tub is supported inside the cabinet. The wash unit tub includes a front tub wall having a front tub opening. The drum is rotatably supported within the wash unit tub. The drum defines a laundry compartment therein and includes a front drum opening that cooperates with the front tub opening to provide access to the laundry compartment. A door is pivotally mounted to the front tub wall of the wash unit tub by a door hinge. A front facia is mounted to the front tub wall of the wash unit tub and extends annularly about the front tub opening. A recirculation hose extends between a pump that is positioned inside the cabinet at a location below the wash unit tub and a recirculation nozzle that is mounted to the wash unit tub at a position near the top of the front tub opening to spray recirculated water into the laundry compartment. The recirculation hose passes through a window in the front facia and is routed through a gap that is disposed between the front tub wall and the front facia to the recirculation nozzle.

In accordance with another aspect of the present disclosure, the front facia includes a front facia wall that is axially spaced in front of the front tub wall by the gap and a facia sidewall that extends axially from the front tub wall to the front facia wall.

In accordance with another aspect of the present disclosure, the window extends through the facia sidewall.

In accordance with another aspect of the present disclosure, the window is positioned below a centerline of the wash unit tub.

In accordance with another aspect of the present disclosure, the window is positioned adjacent to the door hinge.

In accordance with another aspect of the present disclosure, a portion of the recirculation hose runs between a cabinet sidewall of the cabinet and the door hinge.

In accordance with another aspect of the present disclosure, the recirculation hose runs through a protective sheath where the recirculation hose passes through the window in the front facia.

In accordance with yet another aspect of the present disclosure, a laundry appliance is provided that comprises a cabinet, a wash unit tub, and a drum. The wash unit tub is supported inside the cabinet. The wash unit tub includes a front tub wall having a front tub opening. The drum is rotatably supported within the wash unit tub. The drum defines a laundry compartment therein and includes a drum opening that cooperates with the front tub opening to provide access to the laundry compartment. A front facia is mounted to the front tub wall of the wash unit tub. A recirculation hose extends between a pump that is positioned inside the cabinet at a location below the drum and a recirculation nozzle that is mounted to the front tub wall at a position near the top of the front tub opening to spray recirculated water into the laundry compartment. The recirculation hose is routed through a window in the front facia and is secured to the front facia or the front tub wall using at least one fastener.

In accordance with another aspect of the present disclosure, at least one counterweight is positioned between the front tub wall and the front facia. The counterweight(s) is secured to the front tub wall.

In accordance with another aspect of the present disclosure, the counterweight(s) includes a hose routing channel that is configured to receive at least a portion of the recirculation hose.

In accordance with another aspect of the present disclosure, the fastener(s) is attached to the counterweight and secures the recirculation hose within the hose routing channel of the counterweight.

In accordance with another aspect of the present disclosure, the fastener(s) is attached to the front tub wall and secures the recirculation hose to the front tub wall.

In accordance with another aspect of the present disclosure, the front facia includes a front facia wall that is axially spaced from the front tub wall by a gap that receives the recirculation hose and a facia sidewall that extends axially from the front tub wall to the front facia wall. The fastener(s) is attached to the front facia wall and secures the recirculation hose to the front facia wall.

In accordance with yet another aspect of the present disclosure, a laundry appliance is provided that comprises a cabinet, a wash unit tub, and a drum. The wash unit tub is supported inside the cabinet. The wash unit tub includes a front tub wall having a front tub opening. The drum is rotatably supported within the wash unit tub. The drum defines a laundry compartment therein and includes a drum opening that cooperates with the front tub opening to provide access to the laundry compartment. At least one counterweight is secured to the front tub wall. A recirculation hose extends between a pump that is positioned inside the cabinet at a location below the drum and a recirculation nozzle that is mounted to the wash unit tub. The counterweight(s) include a hose routing channel that at least partially receives the recirculation hose.

In accordance with another aspect of the present disclosure, a front facia is mounted to the front tub wall of the wash unit tub and extends annularly about the front tub opening. A portion of the recirculation hose is routed between the front facia and the front tub wall.

In accordance with another aspect of the present disclosure, the recirculation hose passes through a window in the front facia and is routed through a gap that is disposed between the front tub wall and the front facia to the recirculation nozzle.

In accordance with another aspect of the present disclosure, the recirculation hose runs through a protective sheath where the recirculation hose passes through the window in the front facia.

In accordance with another aspect of the present disclosure, the recirculation hose is attached to the counterweight (s) using at least one fastener.

In accordance with another aspect of the present disclosure, the fastener(s) is a clip that engages the counterweight and holds the recirculation hose in the hose routing channel in a seated position.

In accordance with another aspect of the present disclosure, the hose routing channel is disposed on a top side of the counterweight(s).

Advantageously, the laundry appliance described herein improves the performance and efficiency of the wash and rinse cycles, while maximizing the available packaging space within the laundry appliance. More specifically, the positioning of the recirculation nozzle at the top of the front tub opening yields maximum wetting of the laundry positioned within the laundry compartment. Additionally, the routing of the recirculation hose from the pump, through the window in the front facia, and to the recirculation hose makes productive use of the gap that is disposed between the front tub wall and the front facia. Furthermore, the counterweights accommodate the recirculation hose routing by including the hose routing channel that receives the recirculation hose and the fasteners prevent rattling of the recirculation hose within the gap. This design allows the laundry appliance to efficiently recirculate water during the wash and rinse cycles and meanwhile effectively package and secure the recirculation hose.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
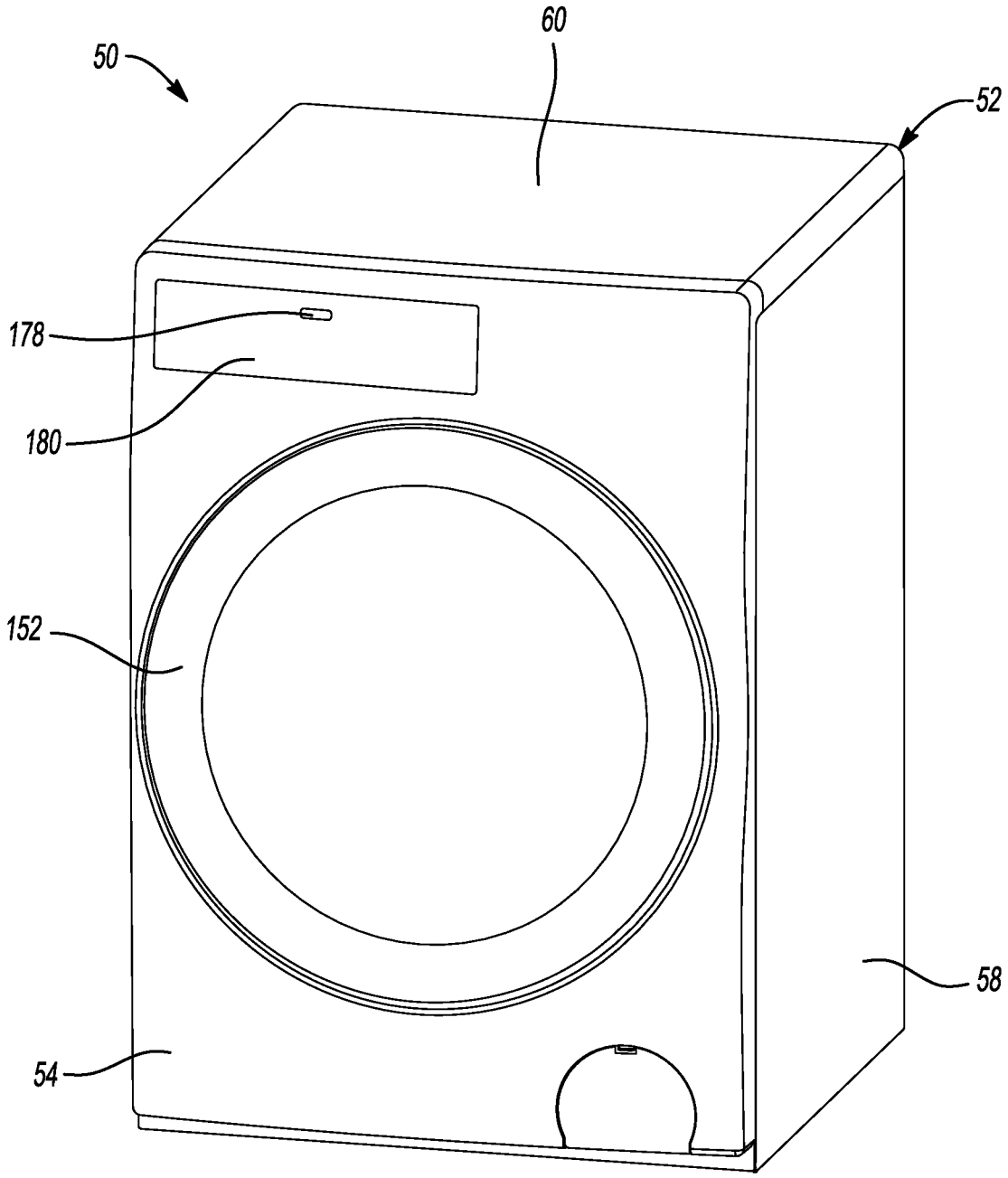
FIG. 1 is a front perspective view of a laundry appliance constructed in accordance with the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a laundry appliance 50 having a front-load configuration is illustrated. The laundry appliance 50 includes a cabinet 52 that is rectangular in shape. The cabinet 52 includes a front cabinet wall 54, a rear cabinet wall 56 opposite the front cabinet wall 54, a set of cabinet sidewalls 58 that extend between the front cabinet wall 54 and the rear cabinet wall 56, a top cabinet wall 60, and a bottom cabinet wall 62. The front cabinet wall 54, rear cabinet wall 56, set of cabinet sidewalls 58, top cabinet wall 60, and bottom cabinet wall 62 cooperate to define a cabinet cavity 64 inside the cabinet 52. The front cabinet wall 54 has a front cabinet opening and the rear cabinet wall 56 has one or more rear cabinet openings 68. The rear cabinet openings 68 may function as an inlet for fluid or gas to flow into the cabinet 52 or an outlet for fluid or gas to flow out of the cabinet 52.

The laundry appliance 50 includes a tub 70 (i.e., a wash unit tub) that is positioned inside the cabinet cavity 64. The tub 70 has a substantially cylindrical shape and extends between a front tub end 72 and a rear tub end 74. The tub 70 includes a front tub wall 76 (i.e., a tub front, a front ring) having a front tub opening 78 at the front tub end 72, a rear tub wall 80 at the rear tub end 74, and a tub sidewall 82 that extends between the front and rear tub ends 72, 74. The front tub wall 76, rear tub wall 80, and tub sidewall 82 cooperate to define a tub cavity 84 inside the tub 70. In the illustrated example, the front tub wall 76 is formed in a curved shape such that the front tub wall 76 extends toward the front cabinet wall 54. The tub sidewall 82 includes a sump 86 that is positioned near the bottom cabinet wall 62. The sump 86 is configured to release fluid from the tub cavity 84. Although other materials can be used, in the illustrated example, the tub 70 is composed of steel.

The tub 70 may include a first opening 90 that extends through the tub sidewall 82 and is positioned adjacent to the front tub wall 76. The first opening 90 may be attached to a first duct 92 that is arranged in fluid communication with the first opening 90. In the illustrated example, the tub cavity 84 is arranged in fluid communication with the cabinet cavity 64 via the first duct 92. In another example, the first duct 92 may extend between the first opening 90 and one of the rear cabinet openings 68. Additionally, the tub 70 may include a second opening 94 that extends through the rear tub wall 80. The second opening 94 may be coupled to a second duct 96 that is arranged in fluid communication with the second opening 94. In the illustrated example, the tub cavity 84 is arranged in fluid communication with the cabinet cavity 64 via the second duct 96 for air to flow into or out of the tub cavity 84. In another example, the second duct 96 may be attached to a heater and a blower for heated air to be blown into the tub cavity 84.

The tub 70 is mounted to the cabinet 52 using one or more suspension elements 98. The suspension elements 98 are attached to the tub sidewall 82 and the bottom cabinet wall 62 at opposing ends. In the illustrated example, the tub is mounted to the cabinet 52 using four suspension elements 98. A first support bracket 100 and a second support bracket 102 are attached to the tub 70. The first and second support brackets 100, 102 are spaced apart from each other such that the first support bracket 100 is positioned near one cabinet sidewall 58 and the second support bracket 102 is positioned near the other cabinet sidewall 58. Each of the first and second support brackets 100, 102 extend between the front and rear tub ends 72, 74. Two suspension elements 98 are secured to the first support bracket 100 at opposing ends of the first support bracket 100 and two suspension elements 98 are secured to the second support bracket 102 at opposing ends of the second support bracket 102. Accordingly, the illustrated example provides four suspension elements 98 that are mounted between the first or second support brackets 100, 102 and the bottom cabinet wall 62. However, in some configurations, the suspension elements 98 may be directly attached to the tub 70. Additionally, there may be a greater or lesser quantity of suspension elements 98 and the suspension elements 98 may be disposed in any suitable position between the cabinet 52 and the tub 70.

The suspension elements 98 are operable to keep the tub 70 from rotating but permit limited degrees of freedom that allow the tub 70 to move/oscillate relative to the cabinet 52 during the operation of the laundry appliance 50. The tub 70 may move/oscillate along a first axis 104 that extends between the front tub end 72 and the rear tub end 74, a second axis 106 that extends between a top side 108 of the tub 70 and a bottom side 110 of the tub 70, and a third axis 112 that extends between a first lateral side 114 of the tub 70 and a second lateral side 116 of the tub 70. In the illustrated example, the tub 70 moves about 20 millimeters along the first axis 104, about 30 millimeters along the second axis 106, and about 35 millimeters along the third axis 112. However, the tub 70 is configured to move/oscillate any suitable dimension along the first, second or third axes 104, 106, 112.

The laundry appliance 50 may include a support panel 118 that is secured to the bottom side 110 of the tub 70. The support panel 118 may extend between the first and second support brackets 100, 102 and be positioned adjacent to the front tub wall 76. More specifically, a first connecting link 120 may attach the support panel 118 to the first support bracket 100 and a second connecting link 122 may attach the support panel 118 to the second support bracket 102.

Figure 4:
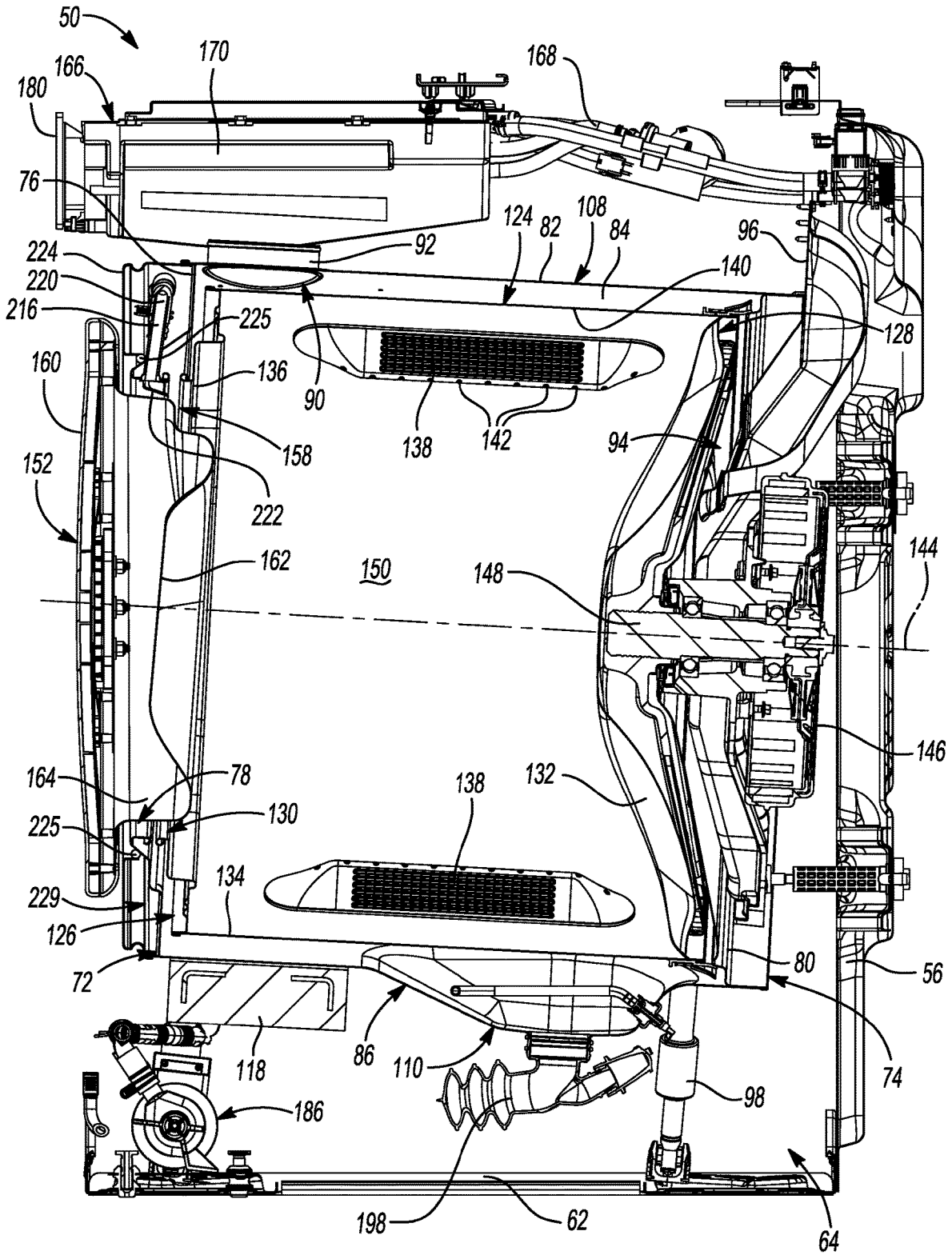
FIG. 4 is a side cross-sectional view of the exemplary laundry appliance shown in FIG. 2.
Figure 6:
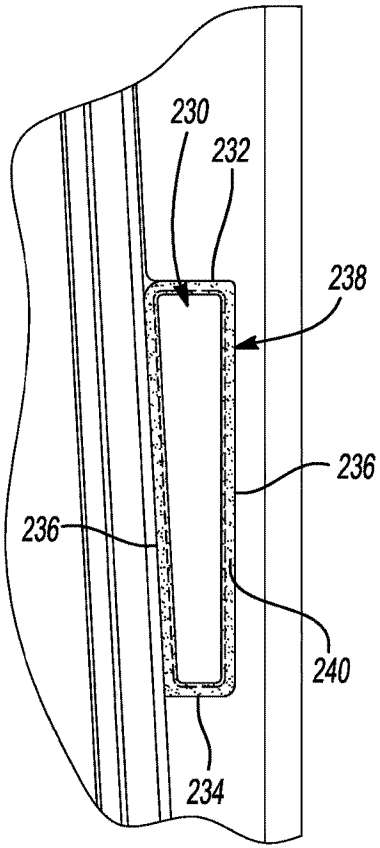
FIG. 6 is an enlarged side view of a window in a front facia of the exemplary laundry appliance shown in FIG. 2.
Figure 5:
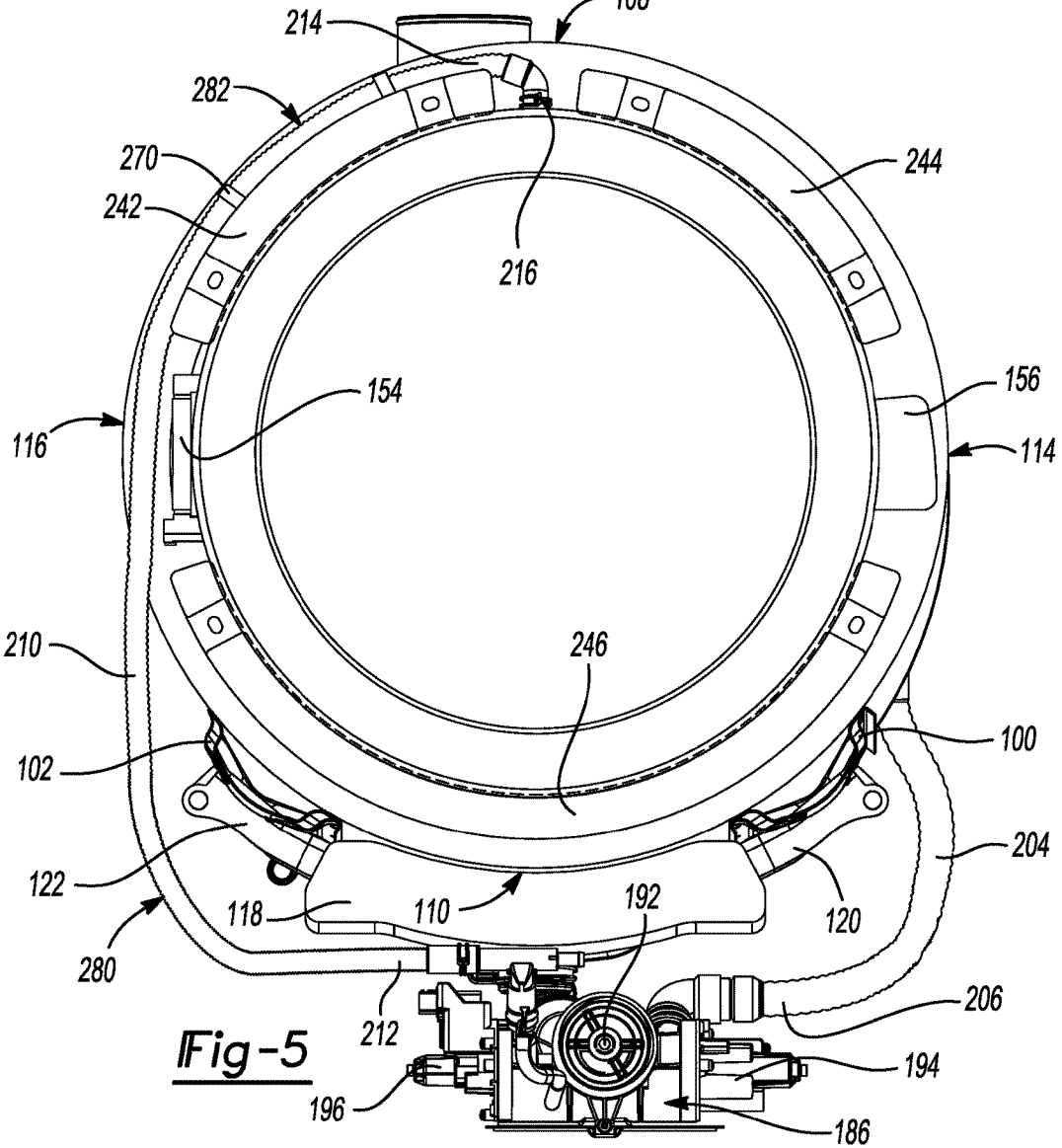
FIG. 5 is a front view of a wash unit tub and a set of counterweights of the exemplary laundry appliance shown in FIG. 2.
Figure 7:
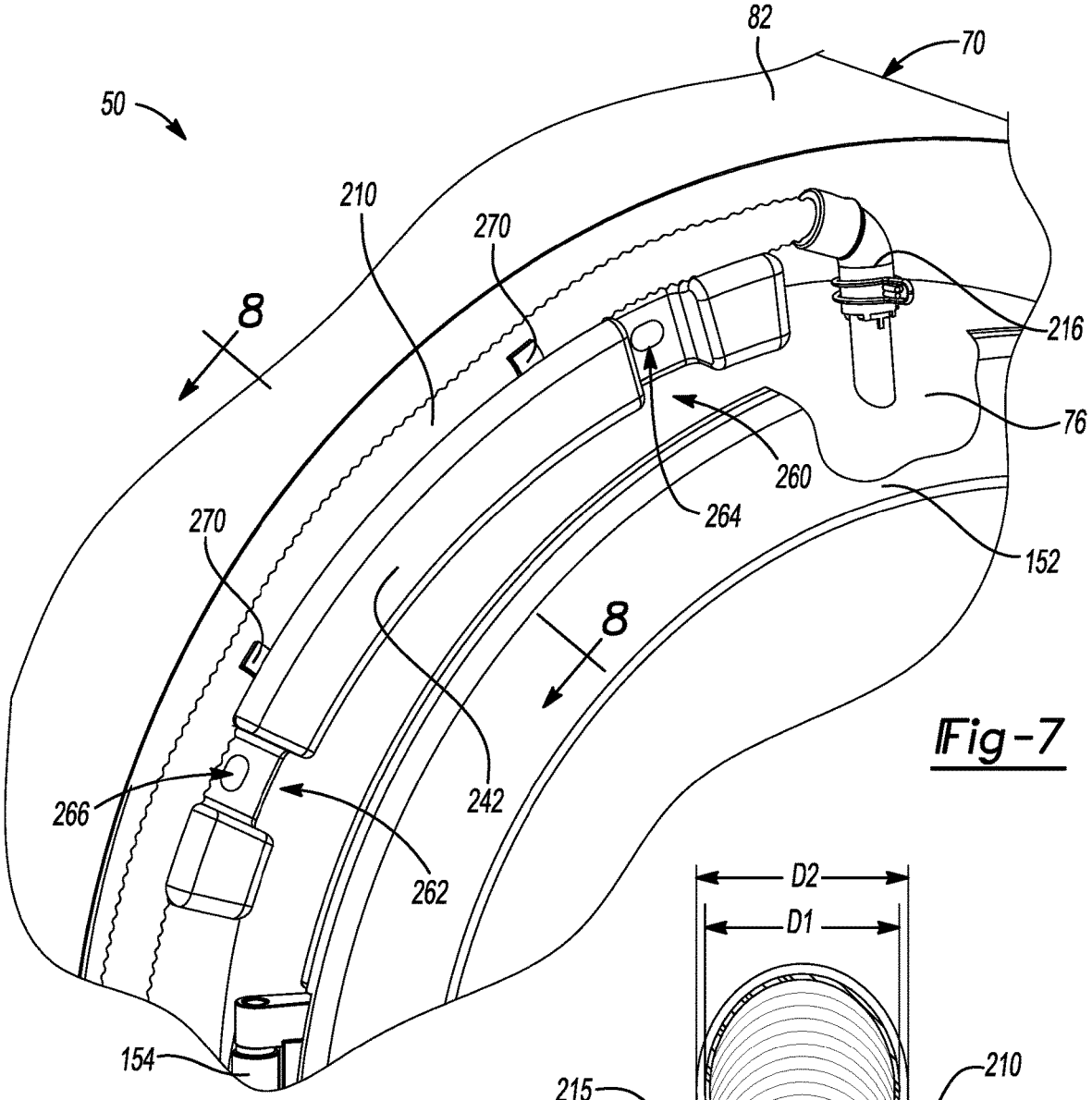
FIG. 7 is an enlarged side perspective view of the exemplary counterweight shown in FIG. 5, where a recirculation hose is attached to the counterweight using a fastener.

With continued reference to FIG. 4, the laundry appliance 50 includes a drum 124 that is positioned in the tub cavity 84. The drum 124 has a substantially cylindrical shape and extends between a front drum end 126 and a rear drum end 128. The drum 124 includes a front drum opening 130 at the front drum end 126, a rear drum wall 132 at the rear drum end 128, and a drum sidewall 134 that extends between the front and rear drum ends 126, 128. In the illustrated example, a front drum seal 136 is disposed annularly about the front drum opening 130 and is secured to the drum sidewall 134. One or more drum protrusions 138 may be secured to an internal surface 140 of the drum sidewall 134 and positioned between the front drum end 126 and the rear drum end 128. A plurality of perforations 142 extend through the drum protrusions 138 and the drum sidewall 134 such that the drum 124 is arranged in fluid communication with the tub cavity 84. In some configurations, the plurality of perforations 142 may extend through the rear drum wall 132, through the drum sidewall 134 or any combination thereof.

The drum 124 is rotatable with respect to the tub 70 about a centerline 144 (i.e., center axis) of the drum 124. An electric motor 146 is positioned within the cabinet 52. More specifically, the electric motor 146 is attached to the rear tub end 74. The electric motor 146 is connected to a drive shaft 148 that extends from the electric motor 146 to the rear drum end 128. The drive shaft 148 is aligned with the centerline 144 of the drum 124. The electric motor 146 operates to drive rotation of the drive shaft 148, which in turn drives rotation of the drum 124 within the tub 70.

The drum sidewall 134, and the rear drum wall 132 cooperate to define a laundry compartment 150 inside the drum 124. The front cabinet opening in the front cabinet wall 54, the front tub opening 78 in the front tub wall 76, and the front drum opening 130 at the front drum end 126 are at least partially aligned with one another. In the illustrated example, the front cabinet opening in the front cabinet wall 54, the front tub opening 78 in the front tub wall 76, and the front drum opening 130 at the front drum end 126 are aligned with the centerline 144 of the drum 124. It should be appreciated that in use, laundry (e.g., clothes, towels, and/or bedding, etc.) is placed inside the laundry compartment 150 where it is first cleaned during the wash cycle and then dried during the drying cycle of the laundry appliance 50.

As shown in FIGS. 1-5, a front appliance door 152 is pivotally connected to the tub 70 and swings between an open position and a closed position. More specifically, the front appliance door 152 is pivotally connected to the front tub wall 76 by a door hinge 154 and is secured in the closed position by a door latch 156. In the open position, the front appliance door 152 provides access to the laundry compartment 150 inside the drum 124. In the closed position, the front appliance door 152 shuts or closes the front tub opening 78 and thereby, restricts access to the laundry compartment 150. However, the front appliance door 152 does not shut or close the front drum opening 130. An access port 158 is positioned radially between the front appliance door 152 and the front drum seal 136. In the illustrated example shown in FIG. 1, the front appliance door 152 is flush with the front cabinet wall 54 when the front appliance door 152 is in the closed position. However, the front appliance door 152 may not be flush with the front cabinet wall 54 in other configurations.

The front appliance door 152 includes an outer door surface 160 that faces away from the front drum end 126 when the front appliance door 152 is in the closed position and an interior door surface 162 that faces the rear drum end 128 when the front appliance door 152 is in the closed position. The front appliance door 152 includes a bowl 164, which extends from the interior door surface 162 of the front appliance door 152. The bowl 164 is received in the front tub opening 78 and at least a portion of the bowl 164 is received in the front drum opening 130 when the front appliance door 152 is in the closed position. Among other functions, the bowl 164 prevents laundry inside the laundry compartment 150 from accumulating in the front tub opening 78 during tumbling and particularly during the wash cycle of the laundry appliance 50.

The laundry appliance 50 includes a wash chemistry assembly 166 that is positioned in the cabinet cavity 64. The wash chemistry assembly 166 includes one or more fluid supply tubes 168, a wash chemistry reservoir 170, and a feed tube 172. Each of the fluid supply tubes 168 extend between a first supply tube end 174 and a second supply tube end 176 that is opposite the first supply tube end 174. The first supply tube end 174 is secured to the rear cabinet wall 56 and is configured to receive fluid. For example, the fluid may be water. The second supply tube end 176 is arranged in fluid communication with the wash chemistry reservoir 170.

The wash chemistry reservoir 170 includes one or more individual compartments (not shown) that are configured to receive wash chemistries. For example, the wash chemistries may include laundry detergent, fabric softener, and bleach. Accordingly, the wash chemistry reservoir 170 may include an individual compartment for each wash chemistry. In the illustrated example, the wash chemistry reservoir 170 has a drawer-like configuration. Accordingly, the wash chemistry reservoir 170 may include a handle 178 that is disposed in a front panel 180 to access the individual compartments. The front panel 180 may be positioned adjacent to or flush with the front cabinet wall 54.

The feed tube 172 extends between a first feed tube end 182 and a second feed tube end 184 that is opposite the first feed tube end 182. The first feed tube end 182 is arranged in fluid communication with the wash chemistry reservoir 170 and the second feed tube end 184 is arranged in fluid communication with the laundry compartment 150. Accordingly, fluid flows through the rear cabinet wall 56 to the fluid supply tubes 168, then from the fluid supply tubes 168 to the wash chemistry reservoir 170, and then from the wash chemistry reservoir 170 to the laundry compartment 150.

The laundry appliance 50 includes a pump assembly 186 (i.e., pump) that is positioned in the cabinet cavity 64. The pump assembly 186 is secured to the bottom cabinet wall 62 and positioned adjacent to the front cabinet wall 54. Accordingly, the pump assembly 186 is disposed below the tub 70. In the illustrated example, the pump assembly 186 operates a drain system and a recirculation system. In the drain system, the pump assembly 186 pumps fluid from the laundry compartment 150 out of the cabinet 52 and thereby, out of the laundry appliance 50. The drain system may be activated after the wash cycle is complete and before the dry cycle begins. In the recirculation system, the pump assembly 186 pumps fluid from the laundry compartment 150 and back into the laundry compartment 150. The recirculation system may be activated during the wash or rinse cycle of the laundry appliance 50. Furthermore, the pump assembly 186 includes a receiving pump 192, a drain pump 194, and a recirculation pump 196. The drain and recirculation pumps 194, 196 are attached to the receiving pump 192 and extend from the receiving pump 192 in opposite directions. Accordingly, the receiving pump 192 is arranged in fluid communication with both the drain and recirculation pumps 194, 196. In some configurations, the receiving pump 192, drain pump 194, and recirculation pump 196 may be spaced apart from each other and arranged in fluid communication with each other via one or more hoses.

The receiving pump 192 is configured to receive fluid from the sump 86. A sump tube 198 extends between a first sump tube end 200 and a second sump tube end 202 that is opposite the first sump tube end 200. The first sump tube end 200 is arranged in fluid communication with the sump 86 and the second sump tube end 202 is arranged in fluid communication with the receiving pump 192. In the illustrated example, the sump tube 198 is positioned below the tub 70.

The drain pump 194 is configured to receive fluid from the receiving pump 192 of the pump assembly 186 and pump fluid to one of the rear cabinet openings 68. A drain hose 204 extends between a first drain hose end 206 and a second drain hose end 208 that is opposite the first drain hose end 206. The first drain hose end 206 is arranged in fluid communication with the drain pump 194 and the second drain hose end 208 is arranged in fluid communication with one of the rear cabinet openings 68 in the rear cabinet wall 56. In the illustrated example, the drain hose 204 is routed adjacent to the suspension elements 98 that are attached to the first support bracket 100.

In the drain system, fluid from the laundry compartment 150 of the drum 124 flows to the sump 86 via the plurality of perforations 142 in the tub sidewall 82. Fluid then flows from the sump 86 to the receiving pump 192 via the sump tube 198. Fluid from the receiving pump 192 is then pumped to the drain pump 194. Fluid from the drain pump 194 is then pumped to exit the cabinet 52 through the rear cabinet opening 68 via the drain hose 204.

Figure 8:
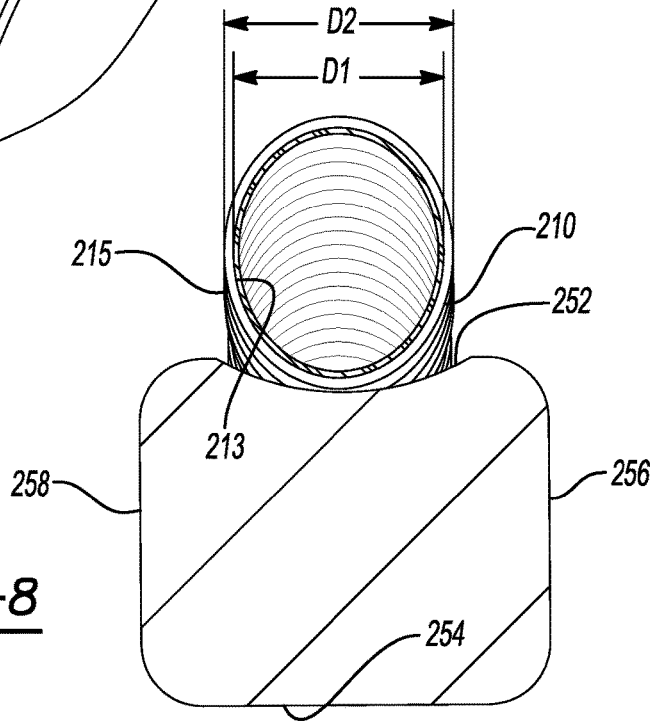
FIG. 8 is a side cross-sectional view of the exemplary recirculation hose and counterweight shown in FIG. 7.
Figure 9:
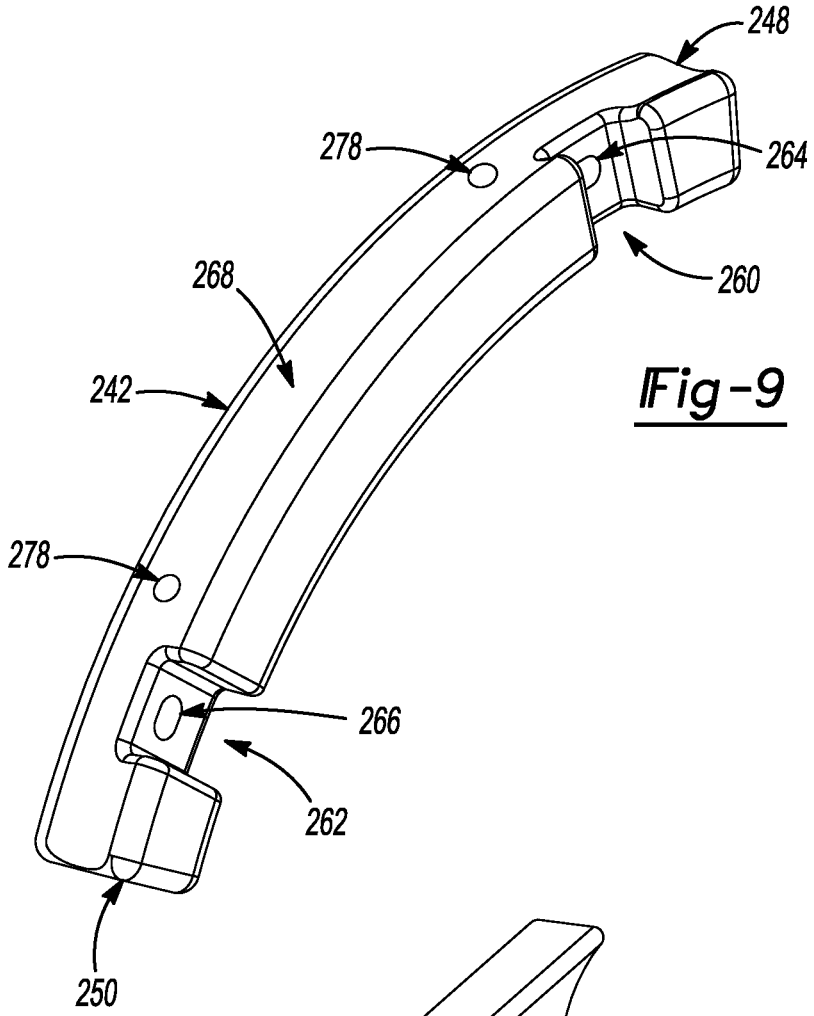
FIG. 9 is a front perspective view of the exemplary counterweight shown in FIG. 7.
Figure 10:
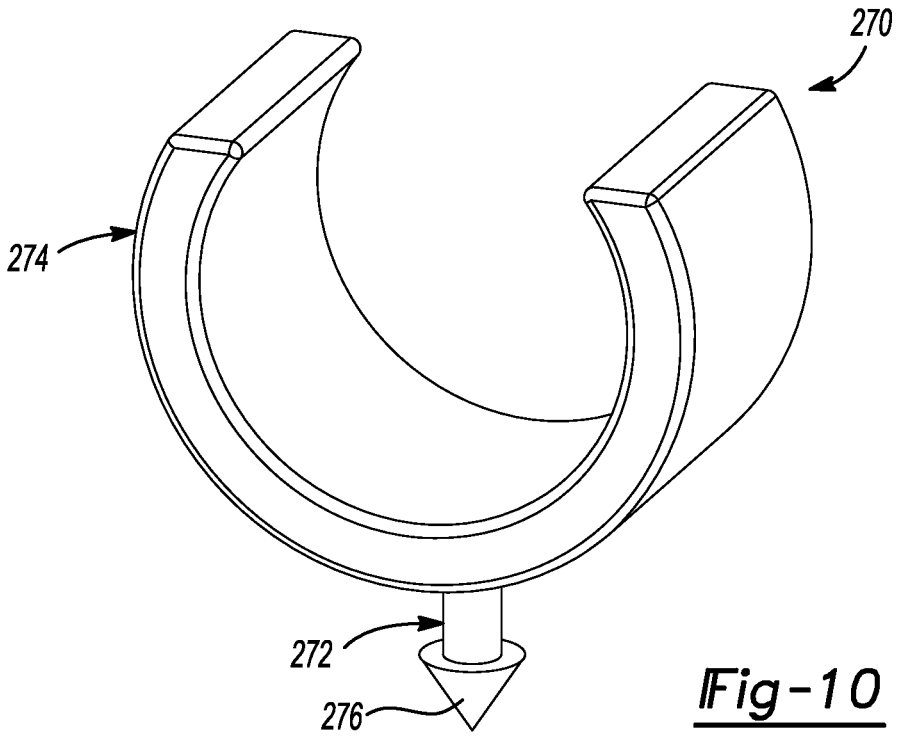
FIG. 10 is a front perspective view of the exemplary fastener shown in FIG. 7.

The recirculation pump 196 is configured to receive fluid from the receiving pump 192 of the pump assembly 186 and pump fluid into the laundry compartment 150. A recirculation hose 210 extends between a first recirculation hose end 212 and a second recirculation hose end 214 that is opposite of the first recirculation hose end 212. The first recirculation hose end 212 is arranged in fluid communication with the recirculation pump 196 and the second recirculation hose end 214 is arranged in fluid communication with the laundry compartment 150. As shown in FIG. 8, the recirculation hose 210 includes an inner surface 213 and an outer surface 215 that is opposite the inner surface 213. A first dimension D1 is measured from opposing ends of the inner surface 213 and a second dimension D2 is measured from opposing ends of the outer surface 215. The first dimension D1 is configured to accommodate a minimum particle size of the fluids that pass through the recirculation hose 210. The second dimension D2 is configured to ensure the recirculation hose 210 meets a strength criteria and the recirculation hose 210 may be packaged with sufficient clearance within the laundry appliance 50. The cross-sectional shape of the recirculation hose 210, may be non-circular. In the illustrated example, the cross-sectional shape of the recirculation hose 210 is elliptical. In other examples, the cross-sectional shape of the recirculation hose 210 may be triangular, square, rectangular, pentagonal, hexagonal, and the like. Although other materials can be used, in the illustrated example, the recirculation hose 210 is composed of plastic.

Returning to FIGS. 1-5, a recirculation nozzle 216 is mounted to the front tub wall 76 and is positioned near the top side 108 of the tub 70. Accordingly, the recirculation nozzle 216 is positioned adjacent to the front tub opening 78. The recirculation nozzle 216 extends between a first nozzle end 220 and a second nozzle end 222 that is opposite the first nozzle end 220. The first nozzle end 220 is positioned outside the tub cavity 84 and is arranged in fluid communication with the second recirculation hose end 214. The second nozzle end 222 is positioned within the tub cavity 84 and is arranged in fluid communication with the laundry compartment 150. The second nozzle end 222 is angled to spray fluids through the front drum opening 130 and into the laundry compartment 150 via the access port 158. Accordingly, the positioning of the recirculation nozzle 216 near the top side 108 of the tub 70 maximizes wetting of laundry that is disposed in the laundry compartment 150. However, the recirculation nozzle 216 may be positioned in any suitable location with respect to the tub 70, such as the first lateral side 114 of the tub 70 or the second lateral side 116 of the tub 70.

In the recirculation system, fluid from the laundry compartment 150 of the drum 124 flows to the sump 86 via the plurality of perforations 142 in the tub sidewall 82. Fluid then flows from the sump 86 to the receiving pump 192 of the pump assembly 186 via the sump tube 198. Fluid from the receiving pump 192 is then pumped to the recirculation pump 196. Fluid from the recirculation pump 196 is pumped to the recirculation nozzle 216 via the recirculation hose 210. Fluid from the recirculation nozzle 216 then flows back into the laundry compartment 150 via the access port 158.

In some configurations, the pump assembly 186 may also include a diverter pump. The diverter pump functions to pump fluids from the sump 86 and back into the sump 86. In yet another configuration, the pump assembly 186 may also include a wash chemistry pump. The wash chemistry pump functions to pump fluids from the wash chemistry reservoir 170 and into the laundry compartment 150 when the wash chemistry reservoir 170 is positioned near the bottom cabinet wall 62.

Figure 2:
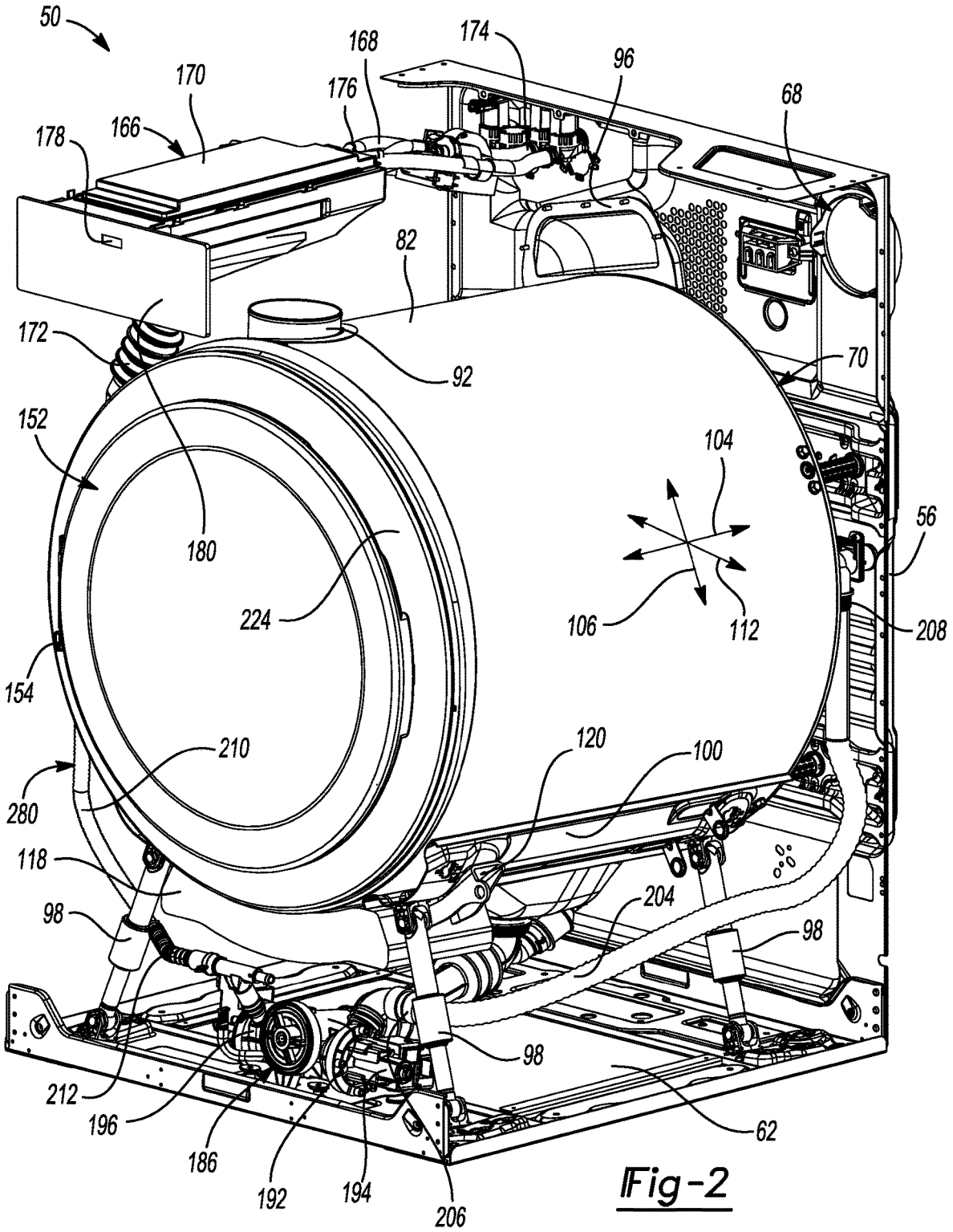
FIG. 2 is a front perspective view of the exemplary laundry appliance shown in FIG. 1, where a front cabinet wall, a top cabinet wall and a set of cabinet sidewalls are removed.
Figure 3:
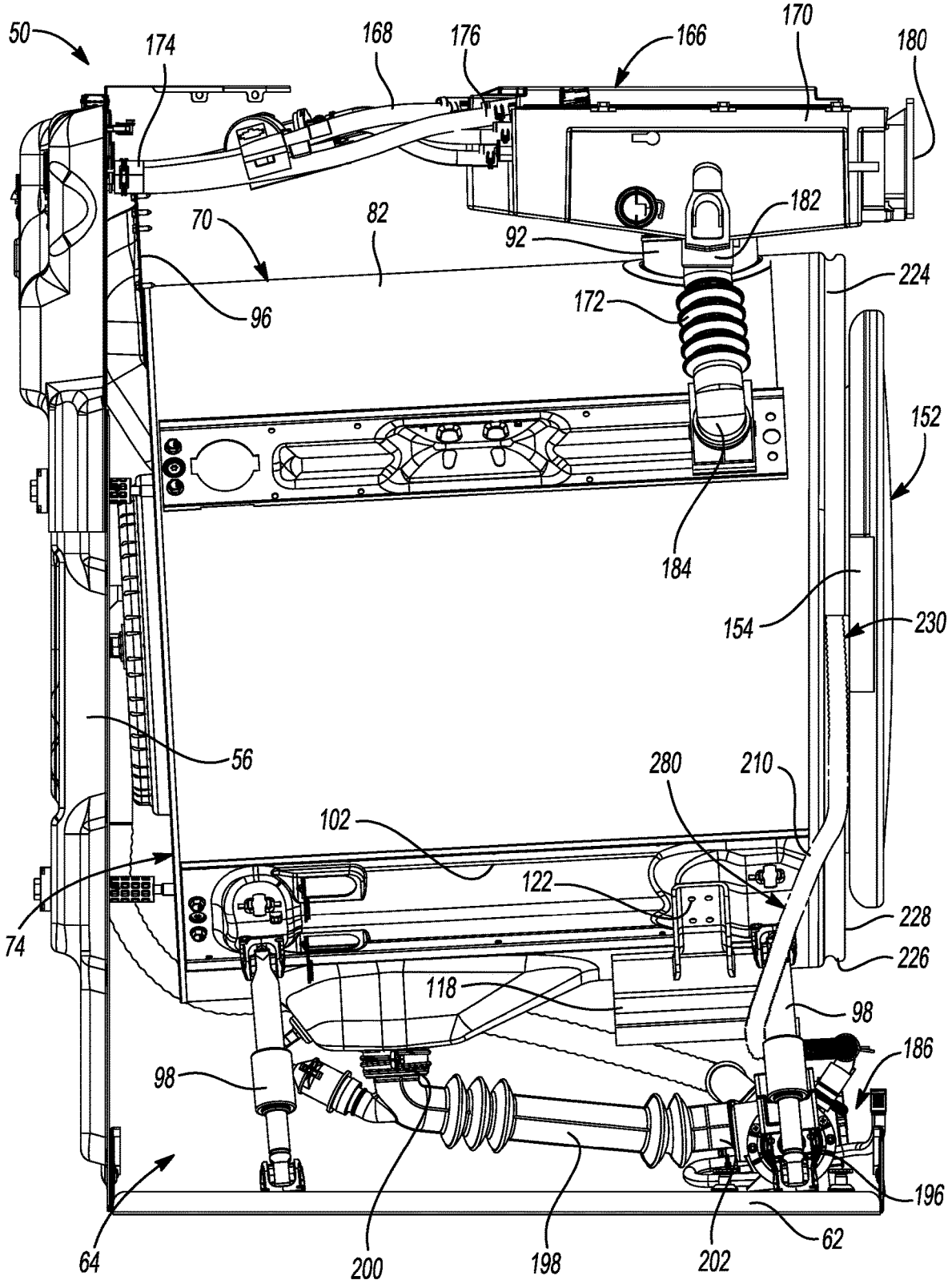
FIG. 3 is a side view of the exemplary laundry appliance shown in FIG. 2.

As shown in FIGS. 2-4, the laundry appliance 50 includes a front facia 224 that is attached to the front tub wall 76 and positioned between the front tub wall 76 and the front appliance door 152 when the front appliance door 152 is in the closed position. The front facia 224 extends annularly about the front tub opening 78. A seal 225 is positioned between the front facia wall 228 and the front tub wall 76 to sealably secure the front facia 224 to the front tub wall 76. The front facia 224 includes a facia sidewall 226 and a front facia wall 228. The facia sidewall 226 extends axially away from the front tub wall 76 and is positioned adjacent to the tub sidewall 82. The front facia wall 228 extends radially away from the facia sidewall 226 and toward the bowl 164 of the front appliance door 152. Accordingly, the front facia 224 is formed in a substantially L-shape. The front facia 224 and the front tub wall 76 cooperate to define a gap 229. The first nozzle end 220 of the recirculation nozzle 216 and the second recirculation hose end 214 is positioned within the gap 229.

With reference to FIGS. 3-6, the facia sidewall 226 includes a window 230. The recirculation hose 210 extends from the cabinet cavity 64 to the gap 229 via the window 230. In the illustrated example, the window 230 is positioned adjacent to the door hinge 154 such that the recirculation hose 210 is routed between the front tub wall 76 and the door hinge 154. More specifically, the window 230 is positioned at least partially below the centerline 144 of the tub 70. However, the window 230 may be positioned in any suitable position within the front facia 224, such as above the centerline 144 of the tub 70 or adjacent to the door latch 156. Additionally in the illustrated example, the window 230 is formed in a rectangular shape and includes a top edge 232, bottom edge 234, and a set of lateral side edges 236. The top edge 232, bottom edge 234, and a set of lateral side edges 236 define an inner perimeter 238 of the window 230. However, the window 230 may be shaped to any suitable shape and sized to any suitable size.

A protective sheath 240 may be disposed along some or all of the inner perimeter 238 of the window 230. For example, the protective sheath 240 may be disposed along the top edge 232, bottom edge 234, lateral side edges 236, or any combination thereof. The protective sheath 240 may be composed of a rubber material, or any other suitable material. The recirculation hose 210 is routed through the protective sheath 240 of the window 230. The protective sheath 240 protects the recirculation hose 210 from any damage that may be caused by the top, bottom, and lateral side edges 232, 234, 236 of the window 230. More specifically, the protective sheath 240 ensures that the plastic material of the recirculation hose 210 does not rub against the metal material of the front facia 224 at the window 230. In some configurations, the protective sheath 240 may sandwich the recirculation hose 210 such that the recirculation hose 210 is restricted from movement within the window 230.

With reference to FIGS. 5 and 7-9, the laundry appliance 50 includes a first counterweight 242, a second counterweight 244, and a third counterweight 246 that are each disposed within the gap 229. More specifically, the first, second, and third counterweights 242, 244, 246 are positioned between the front tub wall 76 and the front facia 224. In the illustrated example, the first counterweight 242 is positioned between the door hinge 154 and the recirculation nozzle 216. The second counterweight 244 is positioned on an opposing side of the recirculation nozzle 216 and substantially mirrors the first counterweight 242 about the recirculation nozzle 216. Accordingly, the second counterweight 244 is positioned between the door latch 156 and the recirculation nozzle 216. The third counterweight 246 is positioned below the first and second counterweights 242, 244. More specifically, the third counterweight 246 is positioned between the door hinge 154 and the door latch 156 and is centered to the recirculation nozzle 216. However, the laundry appliance 50 may include a greater number of counterweights or a lesser number of counterweights. Nonetheless, the counterweights are equally distributed annularly about the front tub opening 78.

Each of the first, second, and third counterweights 242, 244, 246 are secured to the front tub wall 76. More specifically, each of the first, second, and third counterweights 242, 244, 246 extend between a first counterweight end 248 and a second counterweight end 250, and have a top side 252, a bottom side 254 that is opposite the top side 252, a first lateral side 256, and a second lateral side 258 that is opposite the first lateral side 256. A first recess 260 is disposed within the first lateral side 256 of the first, second, and third counterweights 242, 244, 246 and is positioned adjacent to the first counterweight end 248. A second recess 262 is disposed within the first lateral side 256 of the first, second, and third counterweights 242, 244, 246 and is positioned adjacent to the second counterweight end 250. A first aperture 264 extends through the first and second lateral sides 256, 258 of the first, second, and third counterweights 242, 244, 246 and is positioned adjacent to the first recess 260. A second aperture 266 extends through the first and second lateral sides 256, 258 of the first, second, and third counterweights 242, 244, 246 and is positioned adjacent to the second recess 262. A mechanical fastener (e.g., bolt, screw, rivets, etc.) extends through each of the first and second apertures 264, 266 in each of the first, second, and third counterweights 242, 244, 246 to secure the first, second, and third counterweights 242, 244, 246 to the front tub wall 76. In some configurations, each of the first, second, and third counterweights 242, 244, 246 may only include one aperture such that only one mechanical fastener is used to secure the first, second, and third counterweights 242, 244, 246 to the front tub wall 76.

The first counterweight 242 includes a hose routing channel 268 that receives the recirculation hose 210. In the illustrated example, the hose routing channel 268 is formed in the top side 252 of the first counterweight 242. More specifically, the hose routing channel 268 is formed in a curved shape and extends between the first counterweight end 248 and the second counterweight end 250. The recirculation hose 210 abuts the hose routing channel 268 at both the first and second counterweight ends 248, 250. In some configurations, the hose routing channel 268 may additionally be disposed in the second and third counterweights 244, 246. The recirculation hose channel may be formed in any of the top, bottom, first lateral or second lateral sides 252, 254, 256, 258 of the first, second, and third counterweights 242, 244, 246. Additionally, the hose routing channel 268 may be formed in any suitable shape and may extend for any distance between the first and second counterweight ends 248, 250.

With reference to FIGS. 5, 7-8 and 10, the recirculation hose 210 is secured to the first counterweight 242 using one or more fasteners 270. The fasteners 270 are disposed within the hose routing channel 268. Each fastener 270 may be provided in the form of a clip and this may include a mounting portion 272 and a receiving portion 274 that extends from the mounting portion 272. The mounting portion 272 is secured to the first counterweight 242. As an example, the mounting portion 272 may have a substantially cylindrical shape with a barb 276 or alternatively may be shaped as a Christmas tree fastener and is configured to snap into a hole 278 in the first counterweight 242. The receiving portion 274 of the fastener 270 is attached to the recirculation hose 210 to secure the recirculation hose 210 to the first counterweight 242. The receiving portion 274 of the fastener 270 is formed in a shape to contour the cross-sectional shape of the recirculation hose 210. For example, the receiving portion 274 of the of the fastener 270 may be non-circular.

Accordingly, a first portion 280 of the recirculation hose 210 that extends between the first recirculation hose end 212 and the window 230 is not secured to any adjacent component using the fasteners 270, whereas a second portion 282 of the recirculation hose 210 that extends between the window 230 and the second recirculation hose end 214 is secured to the first counterweight 242 using the fasteners 270. Accordingly, the first portion 280 of the recirculation hose 210 moves in response to the movement of the tub 70 along the first, second and third axes 104, 106, 112. The first portion 280 of the recirculation hose 210 is composed of a flexible material. The flexible property of the first portion 280 of the recirculation hose 210 accommodates the movement of the tub 70 and thereby, limits the transmission of forces exerted by the tub 70 to the second portion 282 of the recirculation hose 210. Additionally, the second portion 282 of the recirculation hose 210 is secured to the first counterweight 242 to prevent rattling of the recirculation hose 210 within the gap 229. The second portion 282 of the recirculation hose 210 may be composed of a flexible or non-flexible material.

Figure 11:
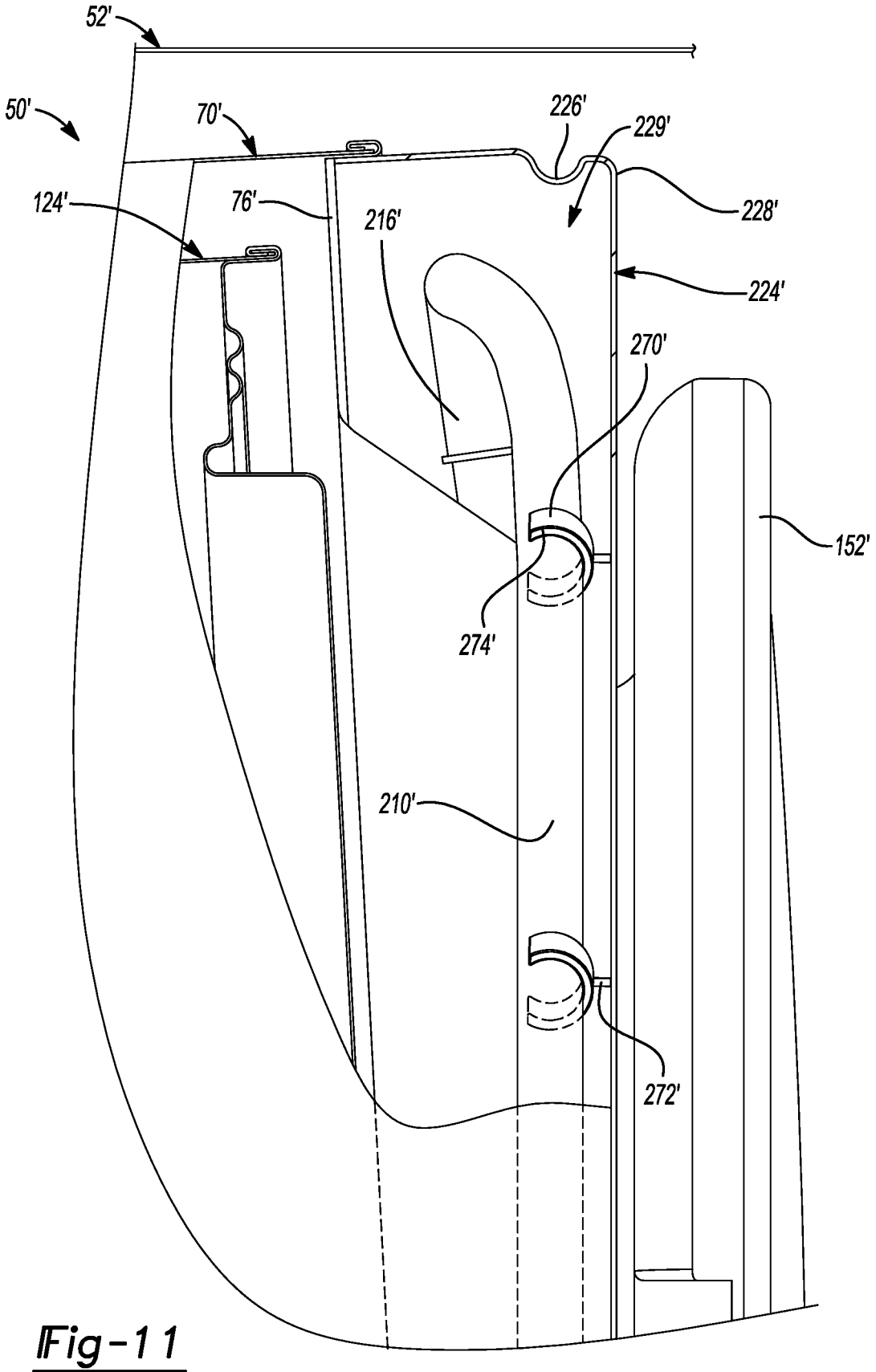
FIG. 11 is an enlarged side perspective view of another laundry appliance constructed in accordance with the present disclosure.

FIG. 11 illustrates another exemplary laundry appliance 50' with a different fastener that is constructed in an alternative configuration. The primary difference is that the laundry appliance 50' of FIG. 11 does not include counterweights, whereas the laundry appliance 50 illustrated in FIGS. 1-10 includes a first, second, and third counterweight 242, 244, 246. Some of the elements of the laundry appliance 50' shown in FIG. 11 are the same or similar to the laundry appliance 50 shown in FIGS. 1-10 and therefore share the same reference numbers but have been annotated with a prime system (') after the reference numerals.

Like the laundry appliance 50 shown in FIGS. 1-10, the laundry appliance 50' shown in FIG. 11 includes a cabinet 52', a tub 70' that is positioned inside the cabinet 52', and a drum 124' that is positioned within the tub 70'. The tub 70' includes a front tub wall 76'. More specifically, the tub 70' is mounted to the cabinet 52' and the drum 124' is rotatable with respect to the tub 70'. A front appliance door 152' is pivotally connected to the tub 70' and swings between an open position and a closed position. Additionally, the laundry appliance 50' includes a recirculation system that pumps fluids from the drum 124' and back into the drum 124' using a recirculation hose 210' and a recirculation nozzle 216'. The recirculation nozzle 216' extends through the front tub wall 76'. A front facia 224' is attached to the front tub wall 76' and positioned between the front tub wall 76' and the front appliance door 152'. More specifically, the front facia 224' includes a facia sidewall 226' and a front facia wall 228'. The front facia 224' and the front tub wall 76' cooperate to define a gap 229'. The recirculation hose 210' and the recirculation nozzle 216' are partially positioned within the gap 229'.

In the embodiment shown in FIG. 11, one or more fasteners 270' are used to secure the recirculation hose 210' to the front facia 224'. The recirculation hose 210' may be secured to the front facia wall 228', as illustrated, or the facia sidewall 226'. In the illustrated example, two fasteners 270' are used to secure the recirculation hose 210' to the front facia wall 228'. However, a greater or lesser quantity of fasteners 270' may be used. Each of the fasteners 270' include a mounting portion 272' and a receiving portion 274'. The mounting portion 272' is secured to the front facia 224'. As an example, the mounting portion 272' may have a cylindrical shape with a barb or alternatively may be shaped as a Christmas tree fastener and is configured to snap into a hole in the front facia wall 228'. The receiving portion 274' is attached to the recirculation hose 210' and is formed in a shape to contour the cross-sectional shape of the recirculation hose 210'. Accordingly, the recirculation hose 210' is secured within the gap 229' and prevented from rattling within the gap 229'.

Figure 12:
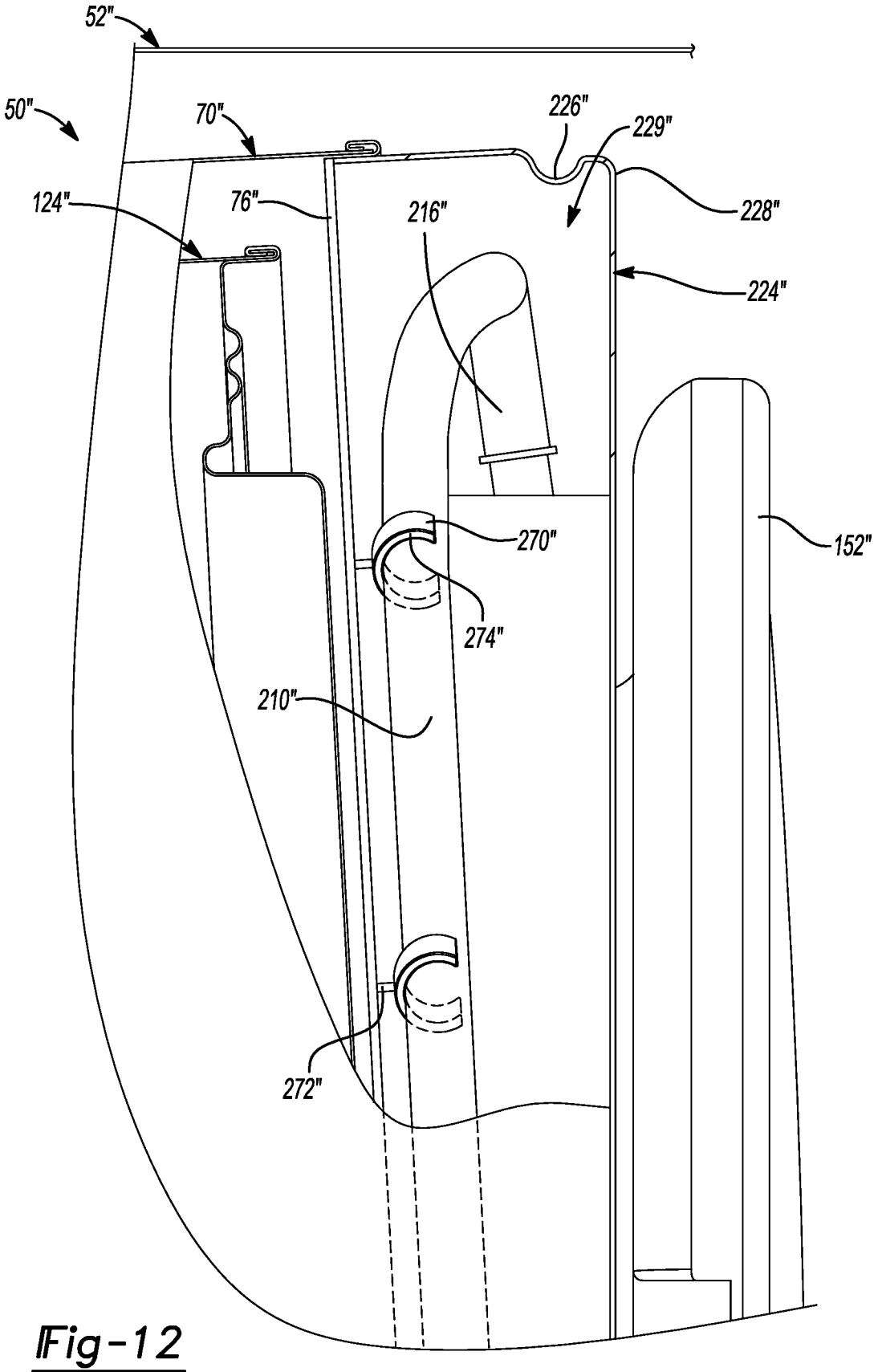
FIG. 12 is an enlarged side perspective view of yet another laundry appliance constructed in accordance with the present disclosure.

FIG. 12 illustrates another exemplary laundry appliance 50" that is constructed in an alternative configuration. The primary difference is that the laundry appliance 50" of FIG. 12 includes a recirculation hose 210" that is attached to a front tub wall 76", whereas the laundry appliance 50 illustrated in FIGS. 1-10 includes the recirculation hose 210 that is attached to the first counterweight 242 and the laundry appliance 50' illustrated in FIG. 11 includes the recirculation hose 210' that is attached to the front facia 224'. Some of the elements of the laundry appliance 50" shown in FIG. 11 are the same or similar to the laundry appliance 50 shown in FIGS. 1-10 and the laundry appliance 50' in FIG. 11 and therefore share the same reference numbers but have been annotated with a prime system (") after the reference numerals.

Like the laundry appliance 50 shown in FIGS. 1-10 and the laundry appliance 50' shown in FIG. 11, the laundry appliance 50" shown in FIG. 12 includes a cabinet 52", a tub 70" that is positioned inside the cabinet 52", and a drum 124" that is positioned within the tub 70". The tub 70" includes a front tub wall 76". More specifically, the tub 70" is mounted to the cabinet 52" and the drum 124" is rotatable with respect to the tub 70". A front appliance door 152" is pivotally connected to the tub 70" and swings between an open position and a closed position. Additionally, the laundry appliance 50" includes a recirculation system that pumps fluids from the drum 124" and back into the drum 124" using the recirculation hose 210" and a recirculation nozzle 216". The recirculation nozzle 216" extends through the front tub wall 76". A front facia 224" is attached to the front tub wall 76" and positioned between the front tub wall 76" and the front appliance door 152". More specifically, the front facia 224" includes a facia sidewall 226" and a front facia wall 228". The front facia 224" and the front tub wall 76" cooperate to define a gap 229". The recirculation hose 210" and the recirculation nozzle 216" are partially positioned within the gap 229".

In the embodiment shown in FIG. 12, one or more fasteners 270" are used to secure the recirculation hose 210" to the front tub wall 76". In the illustrated example, two fasteners 270" are used to secure the recirculation hose 210" to the front tub wall 76". However, a greater or lesser quantity of fasteners 270" may be used. Each of the fasteners 270" include a mounting portion 272" and a receiving portion 274". The mounting portion 272" is secured to the front tub wall 76". As an example, the mounting portion 272" may have a cylindrical shape with a barb or alternatively may be shaped as a Christmas tree fastener and is configured to snap into a hole in the front tub wall 76". The receiving portion 274" is attached to the recirculation hose 210" and is formed in a shape to contour the cross-sectional shape of the recirculation hose 210". Accordingly, the recirculation hose 210" is secured within the gap 229" and prevented from rattling within the gap 229".

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A laundry appliance, comprising: a cabinet;

a wash unit tub supported inside the cabinet, the wash unit tub including a front tub wall having a front tub opening;

a drum rotatably supported within the wash unit tub, the drum defining a laundry compartment therein and including a front drum opening that cooperates with the front tub opening to provide access to the laundry compartment;

a door pivotally mounted to the front tub wall of the wash unit tub by a door hinge; a front facia mounted to the front tub wall of the wash unit tub and extending annularly about the front tub opening; and a recirculation hose extending between a pump that is positioned inside the cabinet at a location below the wash unit tub and a recirculation nozzle that is mounted to the wash unit tub at a position adjacent the front tub opening to spray recirculated water into the laundry compartment, wherein the recirculation hose passes through a window in the front facia and is routed through a gap that is disposed between the front tub wall and the front facia to the recirculation nozzle.

2. The laundry appliance of claim 1, wherein the front facia includes a front facia wall that is axially spaced in front of the front tub wall by the gap and a facia sidewall that extends axially from the front tub wall to the front facia wall.

3. The laundry appliance of claim 2, wherein the window extends through the facia sidewall.

4. The laundry appliance of claim 1, wherein the window is positioned below a centerline of the wash unit tub.

5. The laundry appliance of claim 1, wherein the window is positioned adjacent to the door hinge.

6. The laundry appliance of claim 1, wherein a portion of the recirculation hose runs between a cabinet sidewall of the cabinet and the door hinge.

7. The laundry appliance of claim 1, wherein the recirculation hose runs through a protective sheath, where the recirculation hose passes through the window in the front facia.

8. A laundry appliance, comprising:

a cabinet;

a wash unit tub supported inside the cabinet, the wash unit tub including a front tub wall having a front tub opening;

a drum rotatably supported within the wash unit tub, the drum defining a laundry compartment therein and including a drum opening that cooperates with the front tub opening to provide access to the laundry compartment;

a front facia mounted to the front tub wall of the wash unit tub; and a recirculation hose extending between a pump that is positioned inside the cabinet at a location below the drum and a recirculation nozzle that is mounted to the front tub wall adjacent the top of the front tub opening to spray recirculated water into the laundry compartment, wherein the recirculation hose is routed through a window in the front facia and is secured to at least one of the front facia and the front tub wall using at least one fastener.

9. The laundry appliance of claim 8, further comprising:

at least one counterweight positioned between the front tub wall and the front facia, wherein the at least one counterweight is secured to the front tub wall.

10. The laundry appliance of claim 9, wherein the at least one counterweight includes a hose routing channel that is configured to receive at least a portion of the recirculation hose.

11. The laundry appliance of claim 10, wherein the at least one fastener is attached to the counterweight and secures the recirculation hose within the hose routing channel of the counterweight.

12. The laundry appliance of claim 8, wherein the at least one fastener is attached to the front tub wall and secures the recirculation hose to the front tub wall.

13. The laundry appliance of claim 8, wherein the front facia includes a front facia wall that is axially spaced from the front tub wall by a gap that receives the recirculation hose and a facia sidewall that extends axially from the front tub wall to the front facia wall and wherein the at least one fastener is attached to the front facia wall and secures the recirculation hose to the front facia wall.

14. A laundry appliance, comprising:

a cabinet;

a wash unit tub supported inside the cabinet, the wash unit tub including a front tub wall having a front tub opening;

a drum rotatably supported within the wash unit tub, the drum defining a laundry compartment therein and including a drum opening that cooperates with the front tub opening to provide access to the laundry compartment;

at least one counterweight secured to the front tub wall; and a recirculation hose extending between a pump that is positioned inside the cabinet at a location below the drum and a recirculation nozzle that is mounted to the wash unit tub, wherein the at least one counterweight includes a hose routing channel that at least partially receives the recirculation hose.

15. The laundry appliance of claim 14, further comprising:

a front facia mounted to the front tub wall of the wash unit tub and extending annularly about the front tub opening, wherein a portion of the recirculation hose is routed between the front facia and the front tub wall.

16. The laundry appliance of claim 15, wherein the recirculation hose passes through a window in the front facia and is routed through a gap that is disposed between the front tub wall and the front facia to the recirculation nozzle.

17. The laundry appliance of claim 16, wherein the recirculation hose runs through a protective sheath where the recirculation hose passes through the window in the front facia.

18. The laundry appliance of claim 14, wherein the recirculation hose is attached to the at least one counterweight using at least one fastener.

19. The laundry appliance of claim 18, wherein the at least one fastener is a clip that engages the counterweight and holds the recirculation hose in the hose routing channel in a seated position.

20. The laundry appliance of claim 14, wherein the hose routing channel is disposed on a top side of the at least one counterweight.

* * * * *